US005791055A

United States Patent [19]

Mangol

[11] Patent Number: 5,791,055

[45] Date of Patent: Aug. 11, 1998

[54] KNIFE HANDLE

[75] Inventor: Petra Mangol, Stuttgart, Germany

[73] Assignee: Zwilling J.A. Henckels AG, Solingen, Germany

[21] Appl. No.: 625,086

[22] Filed: Mar. 29, 1996

[51] Int. Cl.[6] ..... B25G 1/10

[52] U.S. Cl. ..... 30/340; D7/649; D8/DIG. 4

[58] Field of Search ..... 30/340, 142, 147, 30/148, 149; 16/110 R; 81/177.1; D8/300, DIG. 4; D7/649

[56] References Cited

U.S. PATENT DOCUMENTS

| | | | |
|---|---|---|---|
| D. 143,250 | 12/1945 | Storm | D8/DIG. 4 |
| D. 154,134 | 6/1949 | McMillen | D8/DIG. 4 |
| D. 193,496 | 8/1962 | Jacoff et al. | D7/649 |
| D. 195,951 | 8/1963 | Wildgen et al. | D7/649 |
| D. 202,395 | 9/1965 | Lamb | D7/649 |
| 3,122,774 | 3/1964 | Lamb | 30/340 |

FOREIGN PATENT DOCUMENTS

| | | |
|---|---|---|
| 95305342 | 3/1996 | China . |
| 952754 | 7/1995 | France . |
| 9503140 | 5/1995 | Germany . |
| 2047102 | 4/1995 | United Kingdom . |

*Primary Examiner*—Hwei-Siu Payer
*Attorney, Agent, or Firm*—Martin A. Faber

[57] ABSTRACT

A handle on blades of knives, or the like, with a cross section which is substantially elliptical over its entire length and having the longer axis of the ellipse in the plane of the knife blade. The cross section reduces towards both ends of the handle in such a manner that the two ellipse axes of the ellipse cross sections of the offset end of the handle and of the free end of the handle are shortened by approximately the same amount. In this connection the two more narrowly curved ellipse arcs develop two vertex lines extending in longitudinal direction and lying in the plane of the knife blade. Of these lines the vertex line extending in the extension of the back of the knife blade forms a wave crest which, at the offset end of the handle, with reversal of curvature, passes aligned into the extension of the back of the knife blade and which, at the free end, terminates in constant curvature in a handle longitudinal section, the latter being bent off to the longitudinal center axis of the handle, and the opposite vertex line forms a wave crest and a wave valley in such a manner that the wave crest lies opposite the descending section of the opposite wave crest and the wave valley is arranged in the region of the roof of the bent-off longitudinal section of the handle.

11 Claims, 7 Drawing Sheets

3
6
2
8
1
7
A 2
4
20
15
b
M
S2
W4
W2
W1
S1
z
S4
III
IV
V
10
9
x
y
A1
11
G
a
12
13
α
5
16
17
14
VI
E
W3
S3
18
19

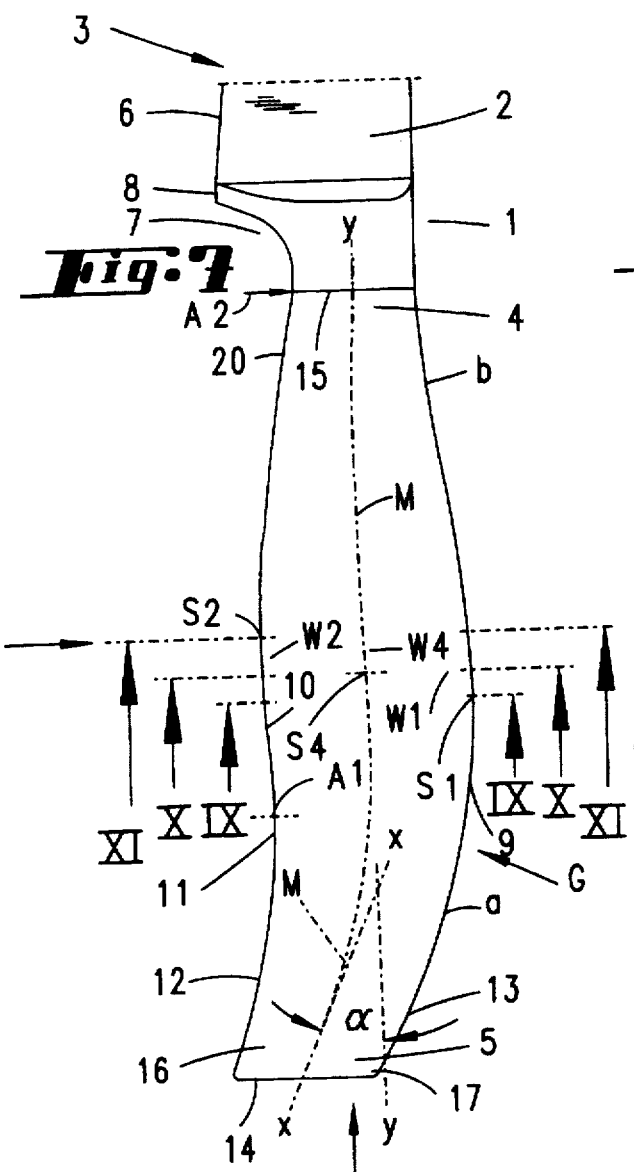
Fig. 7
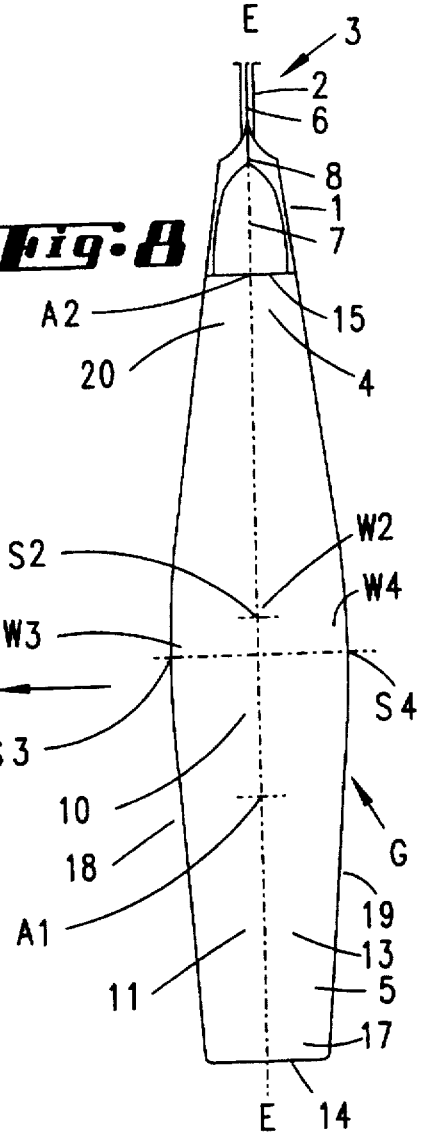
Fig. 8
Fig. 9
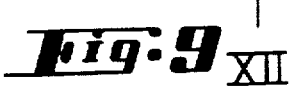
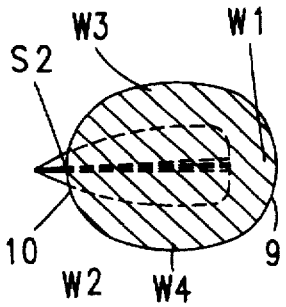
Fig. 10
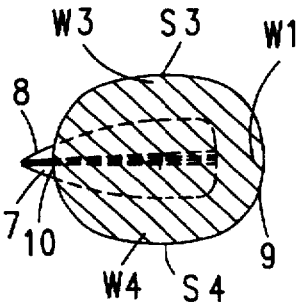
Fig. 11
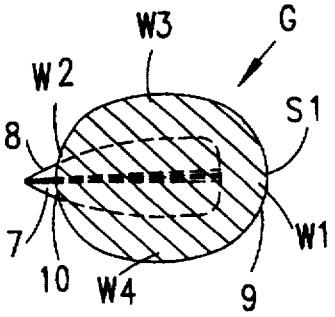

KNIFE HANDLE

FIELD AND BACKGROUND OF THE INVENTION

Knives with handles of the most different contour and longitudinal cross section are known. The handle region is limited by a pommel which becomes thicker in the direction towards the front of the handle and by a more or less pronounced finger guard on the offset end, the finger guard projecting also in the direction of the front of the handle. In the case of woodcarving knives, for example, the free end tapers down in the lengthwise direction of the handle. Furthermore, knife handles the gripping surface of which corresponds to the imprint of the hollow of a gripping hand have also been proposed. The grip limitation is as a rule adapted to a given average size of hand. This leads, even in the case of relatively small deviations (large hand, small hand for grip) to harder work, particularly on the part of the artisan and not infrequently in the household. A dependable "grip" is, however, of considerable importance for safety in the use of such tools. The known handles therefore require improvement.

SUMMARY OF THE INVENTION

With a knowledge and inclusion of the aforementioned facts, it is an object of the invention to ergonomically improve a knife handle of this type, even in the case of different types of blades, without, however, imposing a specific gripping action on the user, so that he is left with room is left for his individual grasp.

As a result of the development of the invention, a knife handle of this type is created which is characterized by an ergonomically substantially improved development of the handle. The handle lies well in the hand and permits an improved, purposeful handling and improved safety of grasp. For this purpose, the invention provides a knife handle having a contour in longitudinal cross section which converges towards the offset end and the free end, the vertex of the convex curvature of the cross-sectional contour line associated with the back of the handle lying further from the offset than the vertex of the convex curvature associated with the front of the handle, and the contour of the longitudinal cross section converging, towards the free end, in the direction of an axis which is inclined to the front of the handle. The handle has a smooth circumferential contour line which is free of sudden changes and breaks. The circumferential contour line thus forms elliptical cross sections which are characterized by the fact that two extremal axes are present which meet approximately in the center of the cross-sectional surface and which are the connecting line of the points of the cross-sectional contour line which are furthest from each other and closest to each other. In the case of ellipses, these extremal axes are formed by the semi-axes of the ellipse. By ellipse there is meant here not only the mathematically precise shape of curve but also all ellipse-like closed curves. The more narrowly curved arches of these curves are then close to the focal points of the ellipses and are in each case connected continuously by the further curved elliptical arcs. In the central region of the handle, the narrow and wide arcs which are opposite each other can be similarly curved. It is preferred to provide, at the free end, a cross-sectional ellipse contour which is egg-shaped, i.e. has a tip pointing towards the heel. In addition to the staggering of the vertices of the convex curvatures of the back of the handle and the front of the handle, which is favorable for gripping, there results, towards the free end, a region of tapering sweep which accommodates the natural reduction of the hollow of the handle-surrounding gripping hand in the region of the little finger. The transition of the vertices of curvature into the converging free end of the knife handle is, of course, effected in a pleasing transition. In addition, it has been found advantageous for the vertex of the convex curvature of the rear of the handle to lie, in axial direction, between the vertex of the convex curvature of the front of the handle and the vertex of a concave curvature in the front of the handle. While retaining a somewhat larger cross-sectional region in the middle of the handle, there results, as a result of the vertex of the concave curvature, towards the end of the handle the desired reduction in cross section, i.e. the approach to each other of the surfaces forming the end on the front side of the handle. The contour of the handle which is of clearly swept shape or as a whole in the form of a longitudinal wave acts to prevent slipping and makes a pommel in the end region, which is frequently felt to be disturbing, unnecessary. The vertex of the concave curvature, i.e. the entire concavity, permits deep insertion of the fingers of the holding hand. Furthermore, a favorable development is present due to an end surface of the free end which extends substantially parallel to the connecting plane on the offset end. Together with the concave curvature in the front side of the handle, there is a "tapering" of the free end of the handle. The opposite is the case on the rear side of the handle. There, there is present, with respect to the end surface, a blunting of the transition of the surfaces, corresponding to an obtuse angle, in such a manner that the vertex of the concave curvature of the front of the handle lies opposite a handle rear section which extends inclined towards the free end in the direction towards the front of the handle. This development also is fully in accord with the anthropometric circumstances of the human hand. The knife handle of the invention is in this connection further characterized by a handle front section adjoining the vertex of the concave curvature which is inclined towards the free end in the direction of the front of the handle. As a whole, there results a substantially S-shaped course of a longitudinal cross section contour center line. It shows, in the drawings, particularly clearly the distribution of the cumulations of material which transform the cross section of the surface. In this connection, furthermore, the center line of the longitudinal cross-sectional contour in the offset-end section of the handle has a smaller curvature than in the free end-side end section of the handle, so that, therefore, the sweep on the front side of the handle is emphasized. Finally, another advantageous feature is a side cross-sectional contour having symmetrical concave curvatures on both sides, the curvature vertices being further from the offset than the curvature vertex of the handle front. As from the convex curvature vertices of the side cross-sectional contour it proceeds, narrowing the cross section, in the direction of both ends, in line with the convergence pointed out above. The transitions between front, side and rear parts of the handle are convexly rounded, without steps, and pleasing. Knives or the like provided with such handles are preferably assembled in sets with similar development of the handle. Such sets of knives or the like have different working ends, with in each case different lengths. It is one aspect of the present invention that, regardless of the length of the working end, the length of the handle is substantially the same. Differing from the prior art where, in the case of sets of knives, the length of the handle is adapted to the length of the working end, in the case of the invention all tools belonging to the set of knives have the same ergometric advantages.

BRIEF DESCRIPTION OF THE DRAWINGS

With the above and other objects and other advantages in view, the present invention will become more clearly understood in connection with the detailed description of preferred embodiments, when considered with the accompanying drawings of which three types of blade provided with handle are shown, they being referred to, for the sake of simplicity, as large knife, medium knife, and small knife, in which:

FIG. 7 shows a knife handle with blade shown in part, as a medium-size knife, such as a bread knife, seen in side view;

FIG. 8 is a bottom view thereof, looking towards the front of the handle;

FIG. 9 is a section along the line IX—IX of FIG. 7;

FIG. 10 is a section along the line X—X of FIG. 7;

FIG. 11 is a section along the line XI—XI of FIG. 7;

DETAILED DESCRIPTION OF THE PREFERRED EMBODIMENTS

The knife handle G of all types of knives shown is continued, via an offset 1 by a blade 2 forming the blade 3 of the knife.

A shank is present in the region behind the offset. The shank is not shown. It is anchored to the knife handle G. The latter can be developed directly by molding on the body of the knife blade. Plastic is favored. Separate manufacture is also possible.

The knife handle G is directed structurally at a development of the handle which, as far as possible, takes into account the attitude of the hand and manner of grasp of the human hand, without, however, attempting a modeling of the imprint of a gripping hand, which upon forceful gripping would result in an undesired, predetermined gripping position. A certain play is to be left with regard to this in order sufficiently to take into account the difference in size of the gripping hand of different persons.

Figures 1, 2, 3, 4, 5:
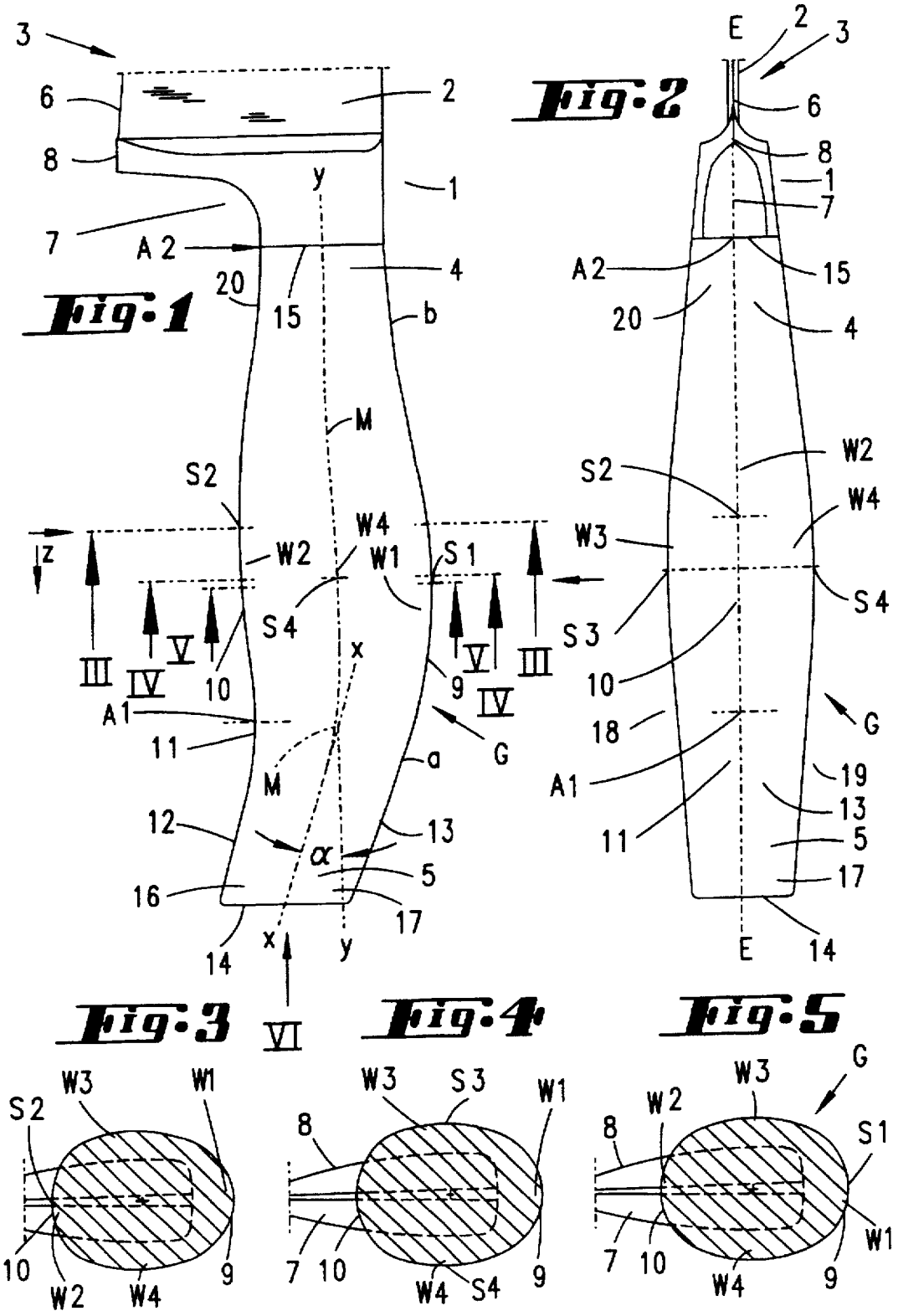
FIG. 1 shows a knife handle with the blade shown in part, as a large knife, for instance a chef's knife, shown in side view.
FIG. 2 is a bottom view thereof, seen looking at the handle front.
FIG. 3 is a section along the line III—III of FIG. 1.
FIG. 4 is a section along the line IV—IV of FIG. 1.
FIG. 5 is a section along the line V—V of FIG. 1.
Figure 6:
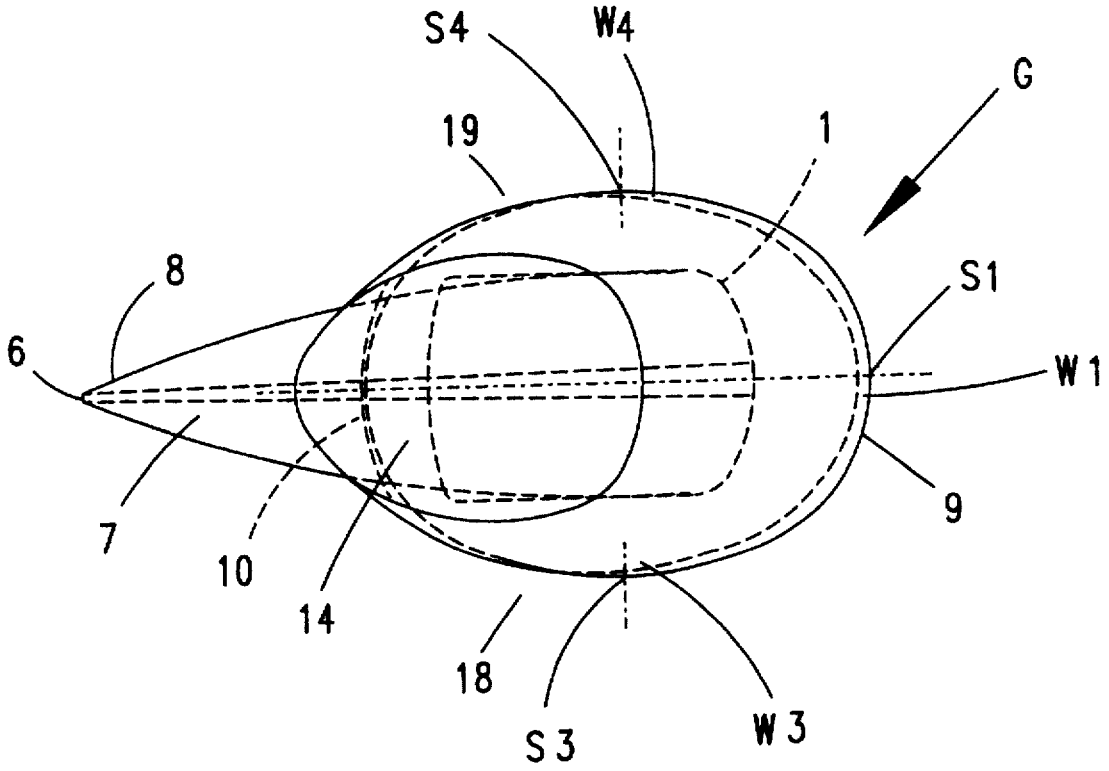
FIG. 6 is an end view of the knife seen in the direction indicated by arrow VI in FIG. 1.
Figure 12:
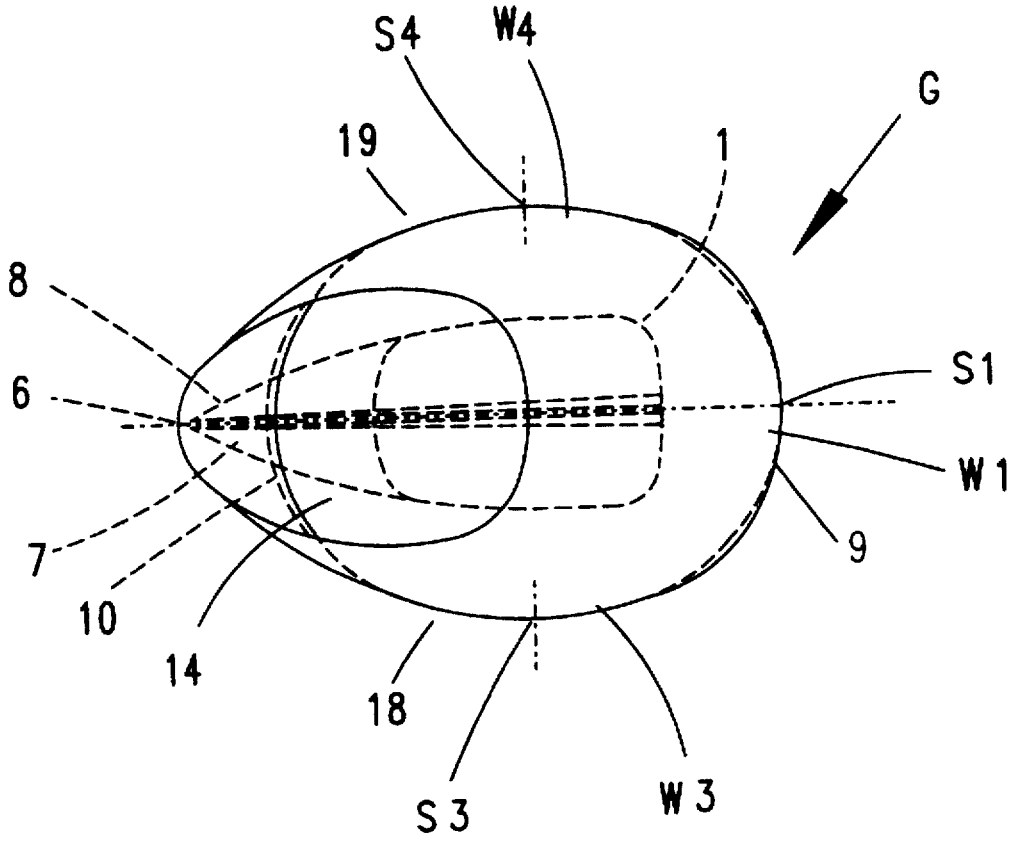
FIG. 12 is an end view of the knife, seen in the direction indicated by the arrow XII in FIG. 7.
Figure 13:
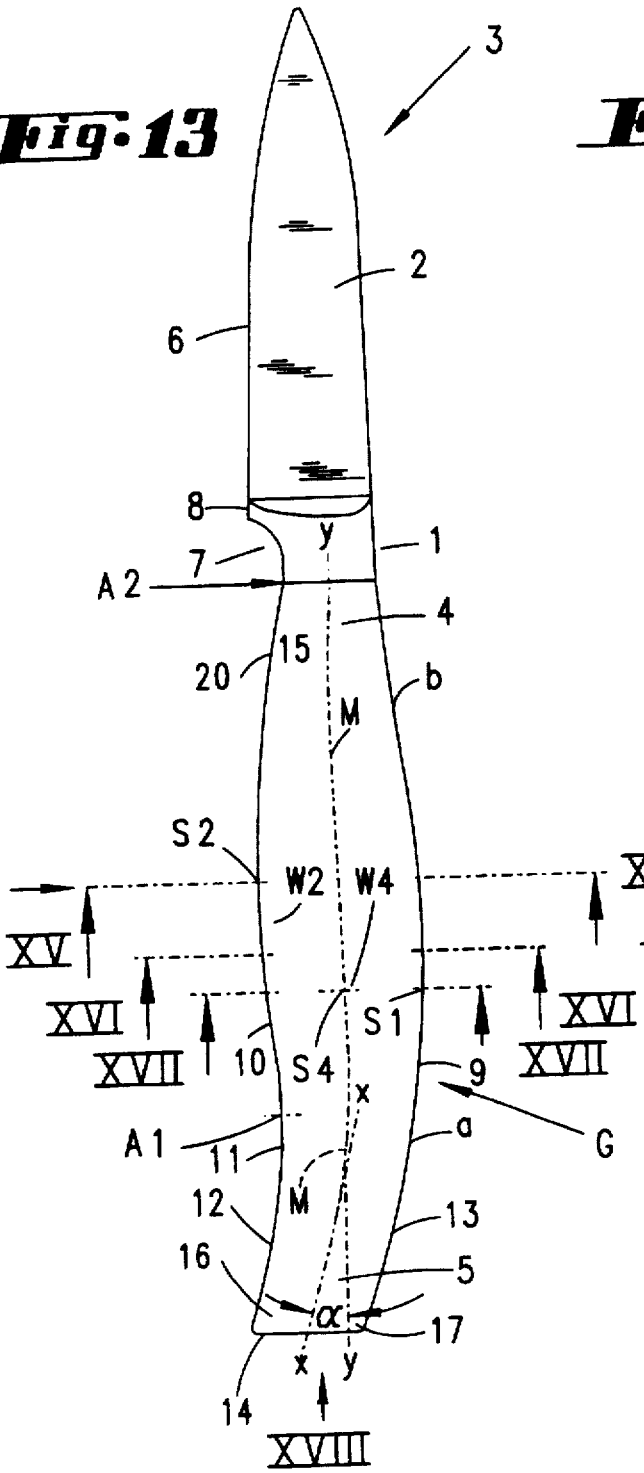
FIG. 13 shows a knife handle with blade shown in its entirety, in the form of a small knife, for instance a paring knife, seen in side view.

For this purpose, the body of the handle has, as a whole, a swept contour, as can be noted from FIGS. 1, 7 and 13, with a slight thickening or crown ascending centrally on all sides.

In this connection, there is a longitudinal cross-sectional contour which converges towards the offset end 4 and towards the free end 5, namely in a continuation which is practically similar in cross section. The offset end 4 fits smoothly into the region behind the offset.

The offset 1 has on the side facing a heel of the blade 3 a finger guard 7 in the form of a finger-insertion trough, adjoining which a more or less protruding beard 8 passes tapered into the heel 6.

The course of the knife handle G which is of non-circular cross section and is swept in the longitudinal direction of the handle results partially from a convex curvature W1 of the handle rear 9 and a convex curvature W2 of the handle front 10. These are outward curvatures. The vertex S1 of the curvature of the longitudinal cross section contour line associated with the handle back 9 lies further from the offset 1 than the vertex S2 associated with the handle front 10.

The corresponding stagger A (FIG. 19) between the convex curvature vertices S1 and S2 in longitudinal direction has led to a corresponding staggering of the convex curvatures (wave crests) W1 and W2 of the knife handle G which are directed opposite each other. The curvatures W1 and W2 therefore recognizably do not lie directly opposite each other, but are spaced apart by up to a finger width. In addition to this, the longitudinal cross sectional contour converges towards the free end 5 in the direction of an axis x—x inclined toward the front of the handle 10. Therefore, there is no convergence in the geometrical principal axis y—y of the knife handle G towards the free end 5 in the contour of the handle as seen in the side views.

The angle of inclination alpha in this end zone is about 20°.

The stagger of curvature in combination with the inclined convergence which is inclined in the sense explained leads to a shape which is extremely suitable for handling and which is adapted to the size of the gripping hand. The tool rests well in the hand, avoids cramping as well as unnecessary stresses, and in particular permits forceful handling.

As can be noted from the figures, the curvature vertex S1 of the handle back 9 lies, in axial direction of the main axis y—y, between the curvature vertex S2 of the handle front 10 and a clear concave curvature vertex A1 of the handle front 10. The concave curvature is designated a wave valley 11. The three vertices lie approximately on the corners of a triangle the length of the sides of which do not differ particularly from each other. The transition from the convex curvature W2 on the front side of the handle to the said concave curvature 11 is smooth and in any event without a step. In the same way, a section 12 of this side of which is included in the convergence adjoins the free end 5. The opposite section 13 of the free end 5 on the rear side comes from the descending section of the convex curvature W1 of the back 9 of the handle.

The free end 5 of the knife handle G passes into a blunt end surface 14. The latter extends substantially parallel to the offset-side attachment plane 15, formed by the region behind the offset. 14 and 15 are perpendicular to the main axis y—y.

This leads, in view of the inclined course of the free end 5, to a sharp edge of this front side of the free end 5 of the handle. The edge which forms an angle of about 75° is provided with the reference numeral 16.

On the rear side of the handle there is produced on the other hand a surface transition between section 13 and end surface 14 having the contour of an obtuse angle, forming an angle of about 110°. This obtuse transition is designated 17.

The vertex of the angle and all free transitions of the handle are rounded convexly.

The main axis y—y extends out from the end surface 14, intersecting approximately the vertex of the angle between section 13 and end surface 14.

The inclined axis x—x is the angle bisector of the sections 12, 13 converging towards the free end. A corresponding, i.e. oppositely directed, convergence is also effected in the region of the sides 18 and 19 of the knife handle G which have a wider surface, particularly in the center; see FIGS. 2, 8 and 14. The taper of the narrower surface side towards the common reference axis amounts to about 5°. It need not be a continuous tapering. Rather, the sides can be included in the curvature ends, as can be noted from the drawings.

The concave curvature vertex A1 of the front of the handle lies opposite a rear section a of the handle which extends inclined to the free end 5 in the direction of the front of the handle; such a handle rear section b which also descends on the front side of the handle is present also in the offset-side end 4. Opposite it, on the front side of the handle there is a concave curvature 20 the vertex A2 of which is aligned with the attachment plane 15. While the rear section a of the handle is of continuous convex curvature, the blade-side end of the other rear section b of the handle terminates in an increasingly stretched contour, with even a slightly concave direction.

As a whole, there results with respect to the knife handle G shown, a substantially S-shaped course of a middle line M of the longitudinal cross-sectional contour. This middle line M is more strongly curved in its sweep to the free end of the handle and more weakly curved in the central and offset-side region. In the latter region it coincides more or less with the principal axis y—y shown in the drawing, or lies, changing sides, nearer it.

Figure 14:
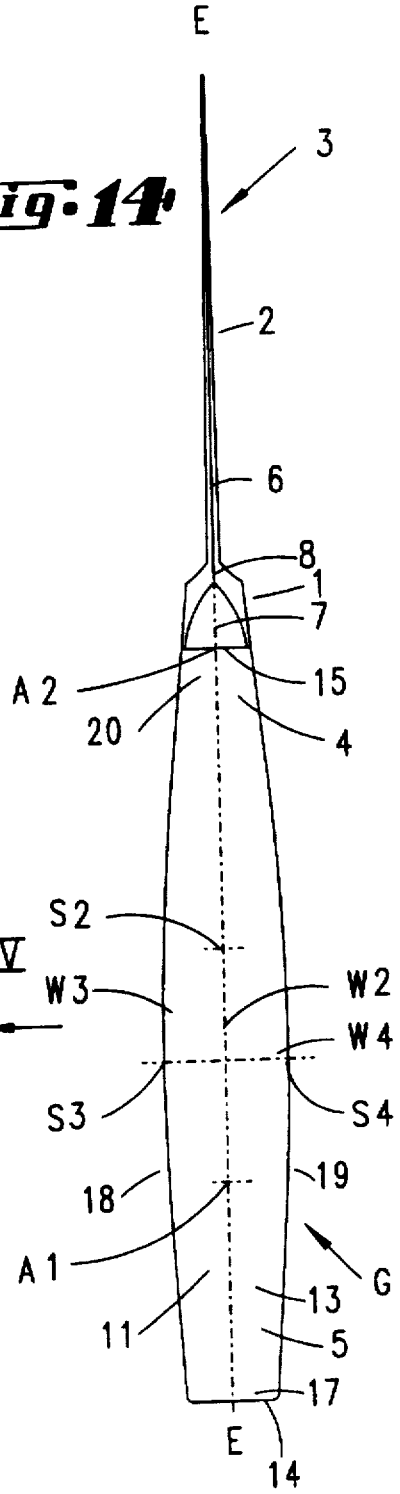
FIG. 14 is a bottom view thereof, looking at the front of the handle.
Figure 15:
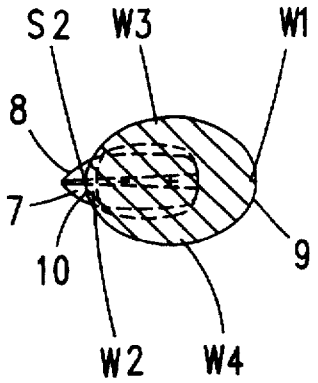
FIG. 15 is a section along the line XV—XV of FIG. 13.
Figure 16:
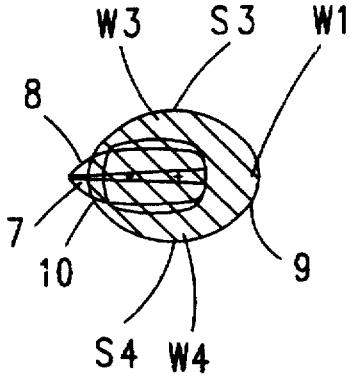
FIG. 16 is a section along the line XVI—XVI of FIG. 13.
Figure 17:
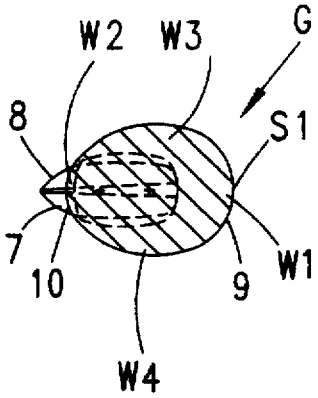
FIG. 17 is a section along the line XVII—XVII of FIG. 13.
Figure 18:
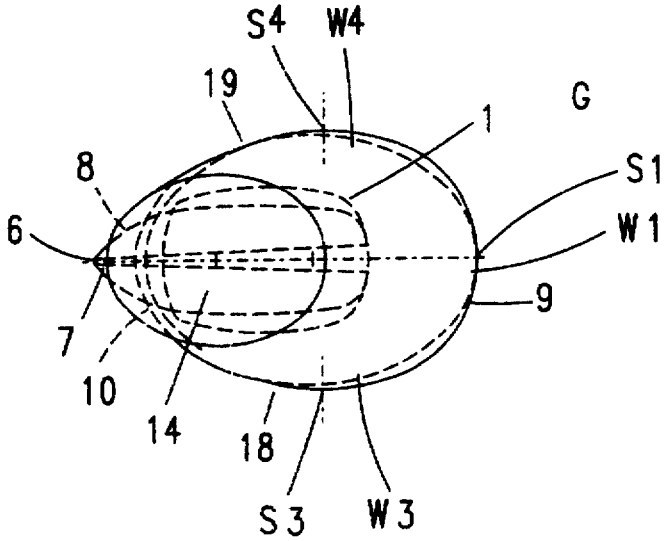
FIG. 18 is an end view of the knife seen in the direction of the arrow XVIII in FIG. 13.

On the other hand, principal axis y—y and center line M also coincide in the top view (FIGS. 2, 8 and 14). They form there a common plane of symmetry E—E. On both sides thereof there are mirror convex curvatures W3 and W4 which determine the contour of the sides 18 and 19 of the knife handle G. These relatively flat curvatures of the side cross-sectional contour of the knife handle thus have their curvature vertices S3 and S4 in a common transverse plane. The curvature vertices S3 and S4 are, roughly speaking, in the region of the longitudinal center of the knife handle G. In the case of the two types of knives shown in FIGS. 1 and 7, it lies between the curvature vertices S1 and S2, but in the type of knife shown in FIG. 13, it lies outside the corresponding transverse planes, shifted in the direction of the free end 5, lying in fact shortly, i.e. a finger's width, behind the curvature vertex S1.

Figure 19:
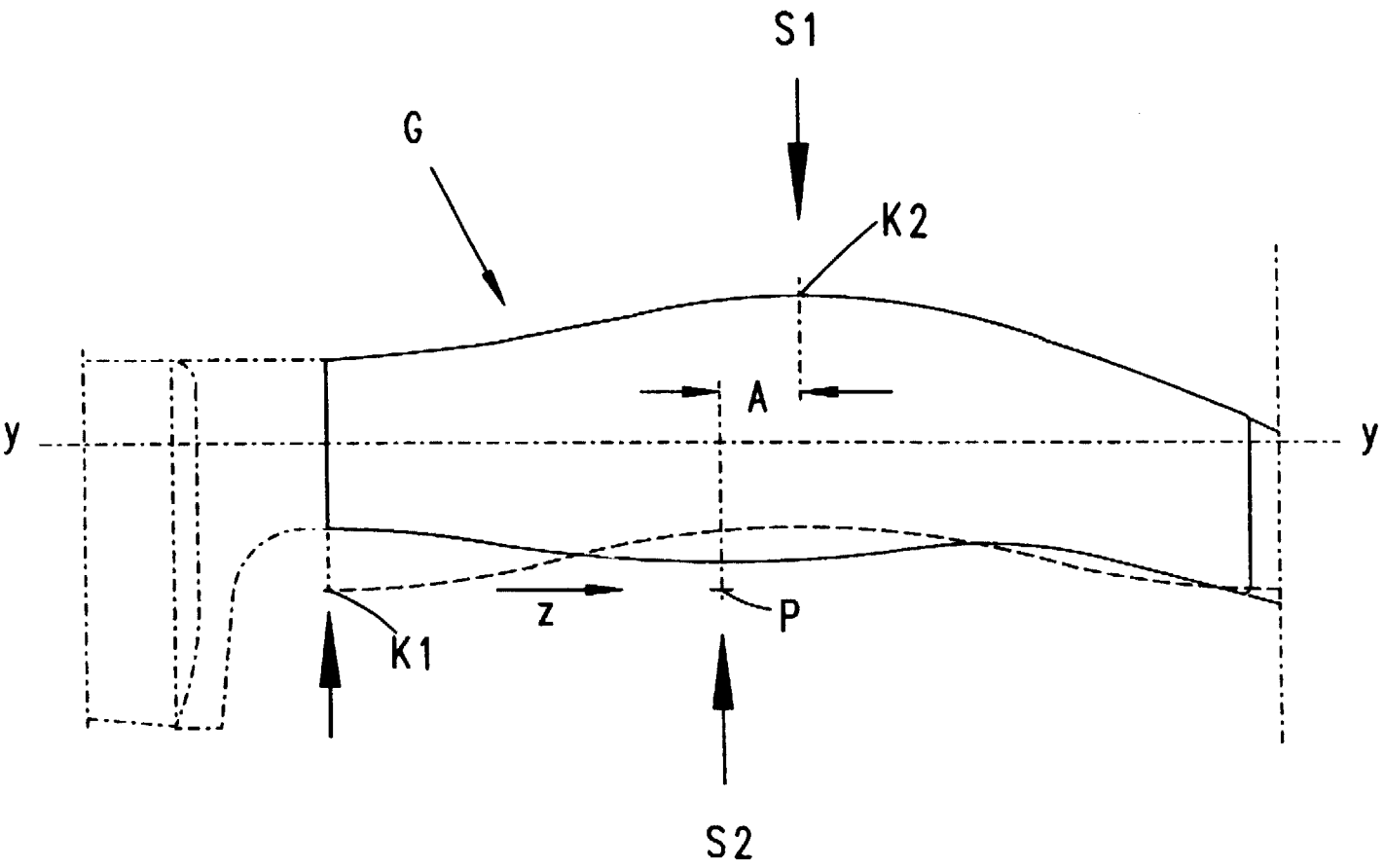
FIG. 19 is a diagrammatic showing of the handle.

On basis of a theoretical analysis referred to FIG. 19, the following may furthermore be stated: Starting from a wave band which is parallel on rear side and front side, in order to create the converging, basic swept figure on the handle side, a displacement of the wave crests and wave valleys is effected in such a manner that a culmination point K1 of the front-side wave which is close to the offset in the lengthwise direction of the handle is shifted in the direction of the arrow z to shortly in front of the plane of the culmination point K2 of the wave on the rear side of the handle, and therefore up to approximately the point P. In this way, the curvature ends approach each other, producing the desired handle contour shown.

With respect to the cross sections, it remains to be stated that they are taken through the plane of the curvature vertices S1, S2, S3/4. The knife handle G has, in these planes, an oval/elliptical cross-sectional shape which continues into the convergence zones. The longer oval/elliptical axis lies in the plane E—E, i.e. the plane of the knife blade. The narrower transverse curvatures therefore are on the rear and front sides. The end of the knife handle G is similar in this connection, rather, to a front contour of a head, or "hanging drop".

At least the outer surface of the knife handle G has a fine ripple-like structure, also in order to contribute to a firm dependable grasp.

I claim:

1. A handle for a blade of a knife, the handle having two ends and a cross section which is substantially elliptical over its entire length and has the longer axis of the ellipse in the plane of the knife blade, said cross section becomes smaller towards both said ends of the handle in such a manner that the two ellipse axes of the ellipse cross section of an offset end of said two ends of the handle and of a free end of said two ends of the handle are shortened by approximately the same amount, wherein two more narrowly curved ellipse arcs of the ellipse form two vertex lines running substantially in longitudinal direction of the handle and in the plane of the knife blade, one of the two vertex lines, extending to an extension of a back of the knife blade, forms a first wave crest which, at the offset end of the handle, with reversal of curvature, extends aligned to the extension of the back of the knife blade and said first wave crest, at the free end, terminates in constant curvature in a handle longitudinal section which is bent off to the longitudinal main axis of the handle, and the other of said two vertex lines forms a second wave crest and a wave valley in such a manner that a vertex of the second wave crest lies opposite a descending section of said first wave crest, and the wave valley is arranged in a region of the bent-off longitudinal section of the handle.

2. A handle according to claim 1, wherein opposite wide-side vertex lines formed by other curved ellipse arcs of the ellipse and extending in said longitudinal direction form first curvature vertices lying approximately in the middle of the handle and in this vertex region, the two more narrowly curved ellipse arcs which lie opposite each other have approximately the same curvature, and the contour lines of the handle so extend towards the free end that, at the free end, the arc on a front of the handle is narrower than the opposite elliptical arc on the rear of the handle.

3. A handle according to claim 2, wherein in the region of the curvature vertices the ratio of small semi-axis to large semi-axis of the ellipse cross section is greater than in the region of an offset-side attachment of the handle.

4. A handle according to claim 2, wherein a convex curvature vertex of said first wave crest at the rear of the handle lies in axial direction between a convex curvature vertex of the second wave crest at the front of the handle and a concave curvature vertex at the wave valley of the front of the handle.

5. A handle according to claim 4, wherein the concave curvature vertex of the front of the handle lies opposite a handle rear section which is inclined to the free end in the direction of the front of the handle.

6. A handle according to claim 4, wherein a handle front section is inclined to the free end in the direction of the front of the handle and adjoins the concave curvature vertex.

7. A handle according to claim 4, wherein said first curvature vertices are symmetrical curvatures, and said first curvature vertices being further from the offset end of the handle than the convex curvature vertex of the second wave crest of the front of the handle.

8. A handle according to claim 1, wherein an end surface of the free end extends substantially parallel to an offset-side attachment plane of the handle.

9. A handle according to claim 1, wherein a middle line of a longitudinal cross-sectional contour of the handle is at least partly S-shaped.

10. A handle according to claim 9, wherein the middle line of the longitudinal cross-sectional contour has a smaller curvature in an offset-side section of the handle than in a free end-side section of the handle.

11. A set of knives comprising several knives, with in each case a handle according to claim 1, wherein the knives have blades of different lengths, and wherein the lengths of the handles of the knives are approximately the same.

* * * * *